US008182165B2

(12) United States Patent
Lee

(10) Patent No.: US 8,182,165 B2
(45) Date of Patent: May 22, 2012

(54) ACTION ORNAMENT FOR MOUNTING ON A ROD OBJECT

(76) Inventor: Pao-Feng Lee, Taipei (TW)

( * ) Notice: Subject to any disclaimer, the term of this patent is extended or adjusted under 35 U.S.C. 154(b) by 484 days.

(21) Appl. No.: 12/461,629

(22) Filed: Aug. 19, 2009

(65) Prior Publication Data

US 2010/0229664 A1 Sep. 16, 2010

(30) Foreign Application Priority Data

Mar. 11, 2009 (TW) ..... 98203698 U

(51) Int. Cl.
*B43K 7/12* (2006.01)

(52) U.S. Cl. ..... 401/117; 401/99; 74/469

(58) Field of Classification Search ..... 401/99, 401/102, 109, 112, 117; 74/469
See application file for complete search history.

(56) References Cited

U.S. PATENT DOCUMENTS

| | | | | | |
|---|---|---|---|---|---|
| 3,741,665 | A * | 6/1973 | Smagala-Romanoff | ..... | 401/117 |
| 3,994,605 | A * | 11/1976 | McKnight | ..... | 401/99 |
| 4,551,035 | A * | 11/1985 | Baker et al. | ..... | 401/104 |
| 4,812,069 | A * | 3/1989 | White et al. | ..... | 401/195 |
| 4,917,519 | A * | 4/1990 | White et al. | ..... | 401/99 |
| 6,340,261 | B1 * | 1/2002 | Furukawa | ..... | 401/216 |
| 7,390,137 | B1 * | 6/2008 | Rentz | ..... | 401/112 |

* cited by examiner

*Primary Examiner* — David M Fenstermacher

(57) ABSTRACT

An action ornament composes of a decoration housing formed by a front and back cases, a main body which engages with said housing, a linkage unit which is partially provided inside the main body and a protracting element hidden and incorporated in the housing and jointed with the linkage unit. A seat is provided on the top of the main body for engaging the case. A hollow tube for attaching a rod object is provided to the bottom of said seat. To actuate the mechanism, a pin is pulled down, driving the linkage unit and causing the housing to open slightly and exposing the protracting element.

12 Claims, 7 Drawing Sheets

ACTION ORNAMENT FOR MOUNTING ON A ROD OBJECT

FIELD OF THE INVENTION

The present invention relates to an ornament, more specifically, a decoration having movable mechanism and can be attached to a rod object for providing amusement.

BACKGROUND OF THE INVENTION

An ornament is usually applied or mounted on our daily used objects for increasing the beauty or providing appearance changing. An ornament can also be a symbol of fashion as it usually represents the preference of a user or the society. An integral molded figure of animal, famous cartoon characters or other objects are often mounted on a pen, chopsticks or others rod-like objects for attracting sight of others. However, such monotonic decoration bores the user easily. Some ornaments are provided with movable parts, thus, movement can be observed during the usage of the objects. Such design improves the amusement of the decoration but it lacks novelty since the objected won't respond the moving of the ornament. Therefore, to provide an ornament with movable part which can drive the reaction of the object coupled with for increasing its amusing factor has become the objective of the present invention.

SUMMARY OF THE INVENTION

To solve above drawbacks, two types of embodiment are disclosed in the present invention. An amusing ornament of the first type comprises a decorative housing (10) which consists of a front rear case (11, 12); a main body (20) which couples with said housing (10) includes a seat (21), disposed on a top of said body (20), and a hollow tube (22), coupled with a bottom of said seat (1). Said seat (21), having a hole (211) in a centre is joined with said rear case (12), and said tube (22), incorporated a horizontal pole (222) has a connecting element (221) disposed on a bottom of said tube (22) for coupling with said rod object (2).

A linkage unit (30A) which is partially provided inside said housing (10), consists essentially of a long driving link (31A) whose a lower portion passes through said hole (211) and is given sliding movement by inserting into the tube (22), a roller as first driven element (32) driven by the long driving link (31A), a second driven element (33) having two ends pin jointed with the seat (21) and first driven element (32) respectively and another end coupled with the front case (11), a first elastic element (50) disposed on where the second driven element (33) pivotally connected with the seat (22) for providing reciprocal movement to the second driven element (33), a second elastic element (51) incorporated in the tube (22) for providing reciprocal movement to the long driving link (31A); and a protracting element (40), incorporated in said housing (10) is pivotally connected with the long driving link (31A).

Accordingly, a wave structure (311) is disposed on a side of an upper portion of the long driving link (31A) for corresponding the first driven element (32); and a groove (312) is disposed on a side of a lower portion of the long driving link (31A) for corresponding said pole (222).

An alternative type of ornament for mounting on a rod object (2) comprises: a decorative housing (10) which consists of a front case (11) and a rear case (12); a main body (20) which couples with said housing (10) includes a seat (21), disposed on a top of said body (20), and a hollow tube (22), attached to a bottom of said seat (1); said seat (21), having a hole (211) in a centre is joined with said rear case (12), and said tube (22), incorporated a horizontal pole (222) has a connecting element (221) which is provided on a bottom of said tube (22) for engaging with said rod object (2).

A linkage unit (30B) which is partially inserted into said housing (10), consists essentially of a short driving link (31B) whose a bottom portion passes through said hole (211) and is allowed to slide inside the tube (22), a forth driven element (35) driven by the short driving link (31B), a fifth driven element (36) having three ends pin jointed with the seat (21), the forth driven element (35) and first driven element (32) respectively, a second driven element (33) having two ends pivotally connected with the seat (21) and first driven element (32) respectively and another end coupled with the front case (11). A first elastic element (50) disposed on where the second driven element (33) pivotally connected with the seat (22) for providing reciprocal movement to the second driven element (33), a second elastic element (51) incorporated in the tube (22) for providing reciprocal movement to the short driving link (31B); and a protracting element (40), incorporated in said housing (10) is pivotally connected with the fifth driven element (36).

Accordingly, a groove (312) is disposed on a side of the short driving link (31B) for corresponding said pole (222).

Moreover, a third driven element (34) is pin jointed with a bottom end of both long and short driving link (31A, 31B) for driving the rod object (2), and a groove (341) is disposed on a side of the third driven element (34) for corresponding said pole (222).

Further, a third elastic element (52) is disposed on where the long and short driving link (31A, 31B) joint with the third driven element (34) respectively for providing reciprocal movement. A protruding pin (313) is provided on a side of both driving links (31A, 31B); and a guide slot (223) is disposed on a side wall of the tube (22) for allowing the pin (313) to pass through and limiting the movement thereof.

COMPARISON TO THE PRIOR ART

The present invention possesses following advantages:

1. By incorporating a linkage into the decoration, the present invention is allowed to perform reciprocal action, actuating the object coupled with while reacting, providing attraction to the user.
2. Both linkage units (30A, 30B) have simple structures and are easy to be manufactured and assembled, making the ornament being cost-effective and reliable.
3. The protracting element (40) can be formed in various shapes to accord with the housing (10). It can be a character elongates the tongue, exposes the body or other appearance, which can increases the amusing factor of the object.
4. By coupling an additional third driven element (34) to the linkage unit, both long and short driving links (31A, 31B) will slide vertically without any inclination when contacting the pole (222) of the tube (22) and a third elastic element (52) is further disposed between the driving links (31A, 31B) and said third driven element (34) to retract the element to the original position thereof. Said design ensures a smooth movement of the driving link and avoids damages to other components of the present invention from the inclined driving link.

DETAILED DESCRIPTION OF PREFERRED EMBODIMENTS

Figure 1:
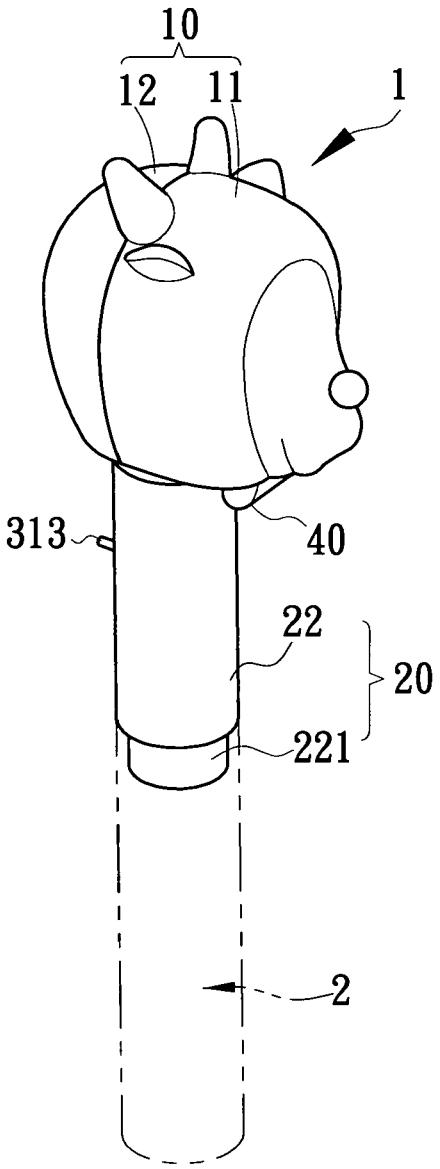
FIG. 1 is a schematic view of the present invention in retraction state.
Figure 2:
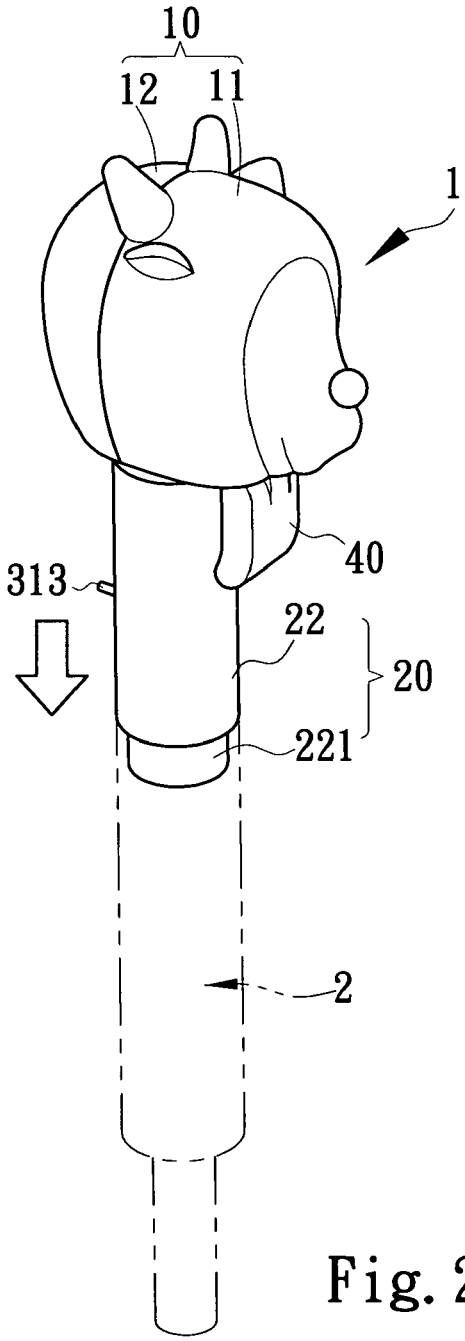
FIG. 2 is a schematic view of the present invention in protraction state.
Figure 3:
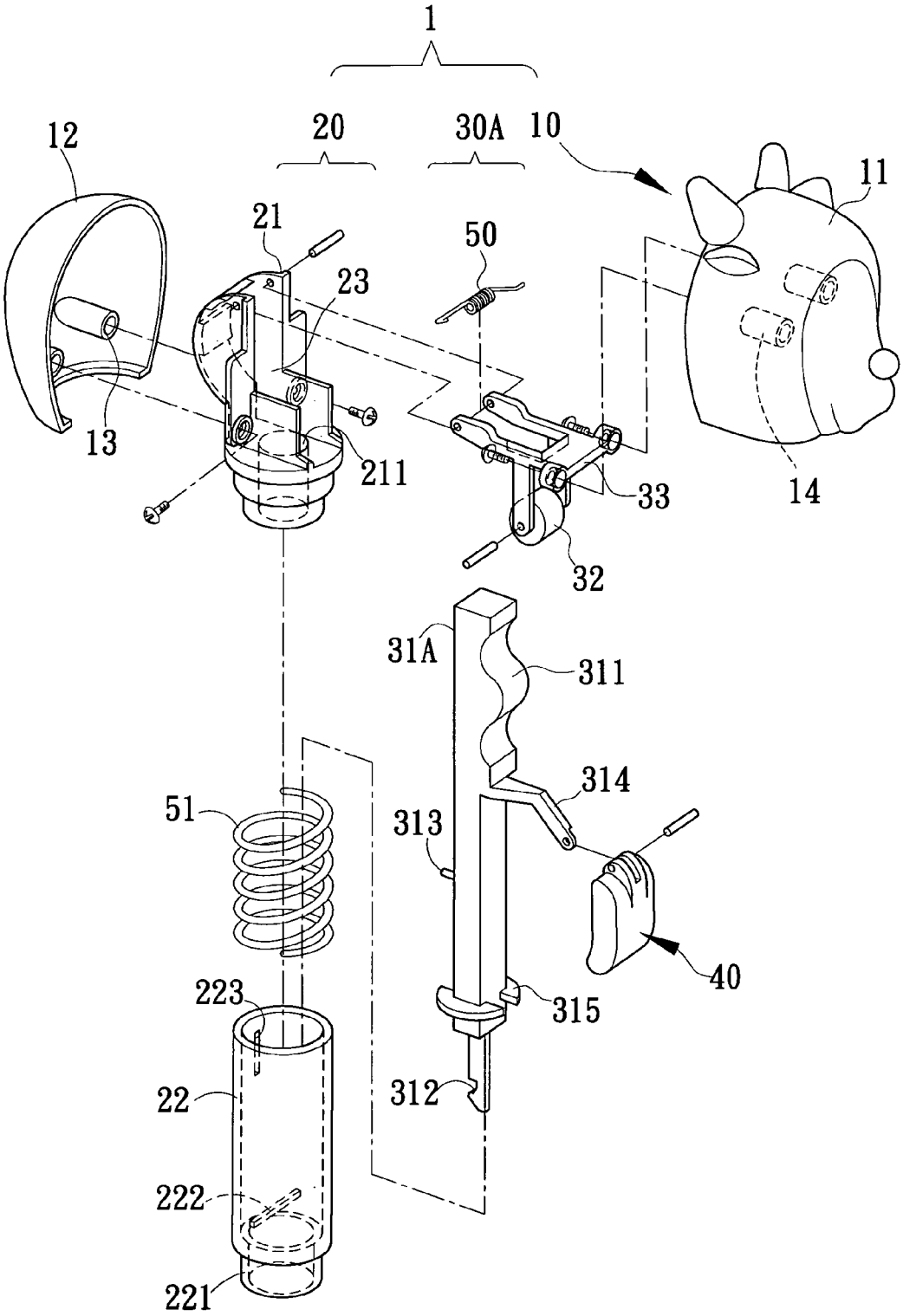
FIG. 3 is an exploded view of the first embodiment.

The description of embodiments are described in detail according to the appended drawings hereinafter.

First Embodiment

As shown in FIGS. 1-5, an amusing ornament (1), having one end mounted on a rod object (2) consists essentially of a decorative housing (10); a main body (20) which couples with said housing (10); a linkage unit (30A) which is partially inserted into said housing (10) and a protracting element (40), incorporated in said housing (10) is pivotally connected with the long driving link (31A).

Said housing (10) consists of a front case (11) and a rear case (12); and two sets of sockets (13, 14) are disposed on the inner wall of said cases respectively for retaining said linkage unit (30A).

The main body (20) has a seat (21) disposed on an upper portion thereof for coupling with the rear case (20). A hole (211) is set on the center of the seat (21), and a hollow tube (22) is set on the bottom of the seat (21). A connecting element (221) for coupling with said rod object (2) is disposed on a bottom portion of said tube (22). Said tube (22) also incorporates a horizontal pole (222) on its lower portion. A slot (23) for providing limited movement to the linkage unit (30A) is set on a side of the seat (21). The connecting element (221) is jointed with the rod object (2) by screwing or snap-fit.

The linkage unit (30A) includes a long driving link (31A) whose a bottom portion passes through said hole (211) and is given sliding movement by inserting into the tube (22), a first driven element (32) driven by the long driving link (31A), a second driven element (33) having two ends pivotally connected with the seat (21) and first driven element (32) respectively and another end coupled with the front case (11), a first elastic element (50) disposed on where the second driven element (33) pin jointed with the seat (22) for providing reciprocal movement to the second driven element (33), and a second elastic element (51) incorporated in the tube (22) for providing reciprocal movement to the long driving link (31A). An arm (314) is extended form a side of said long driving link (31A) for pin jointing a protracting element (40). A retainer (315) is disposed on a lower portion of said driving link (31A) for retaining said elastic element (51).

By fixing the linkage unit (30A) onto the main body (20), the housing (10) and protracting element (40) are allowed to move reciprocally. The retract/protract feature of said protracting element (40) can be linked to a element (2) having same feature, such as a retractable pen, which means that when a pen refill is protracted from the pen, said protracting element (40) is driven to expose form the housing (2), and when refill is retracted, the element (40) is also retracted into the housing (10).

A wave structure (311) is disposed on a side of an upper portion of the long driving link (31A) for providing movement to the first driven element (32) and actuating said front case (11). A groove (312) which corresponds with said pole (222) and serves as a retainer is disposed on a side of a lower portion of the long driving link (31A). Said first driven element (32) is a roller.

A protruding pin (313) is extended from a side of said long driving link (31A) to allow user controlling the linkage unit (30A). A guide slot (223) is disposed on a side wall of the tube (22) for allowing the pin (313) to pass through and limiting the movement thereof.

Figure 4:
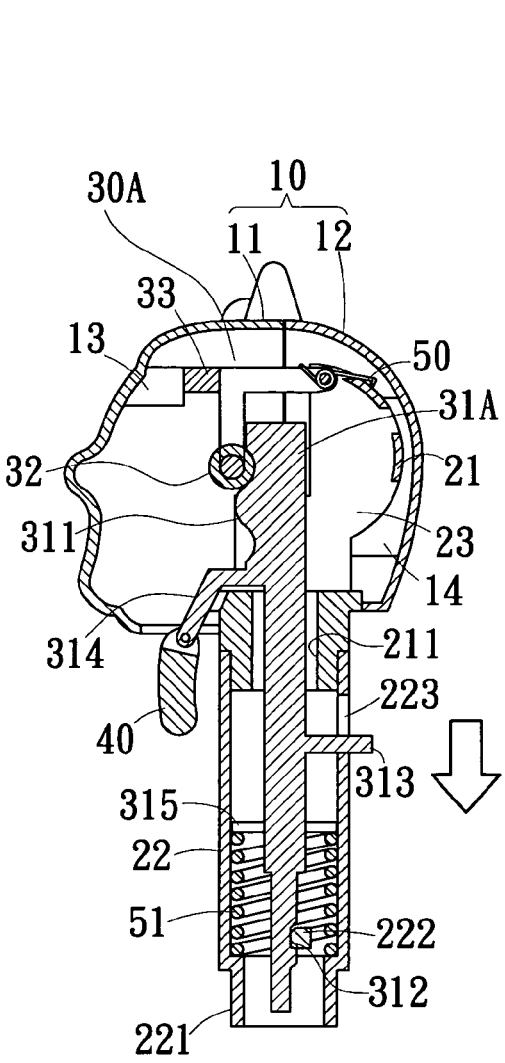
FIG. 4 is a sectional view of the first embodiment in protraction mode.

As illustrated in FIG. 4, the function of the ornament is described as follow: when the protruding pin (313) is pulled downwardly, the first driven element (32) rolls over the wave-like surface of structure (311). When the element (32) reaches the crest, the second driven element (33) which is pivotally connected with the element (32) forces the front case (11) to open a space for exposing the protracting element (40). The first elastic element (50) is compressed by the retainer (315) and the movement is retained when the pole (222) incorporated in the tube (22) engages the groove (312) of said driving link (31A), and the front case (11) is retracted to its original position by a first elastic element (50) disposed on the second driven element (33).

Figure 5:
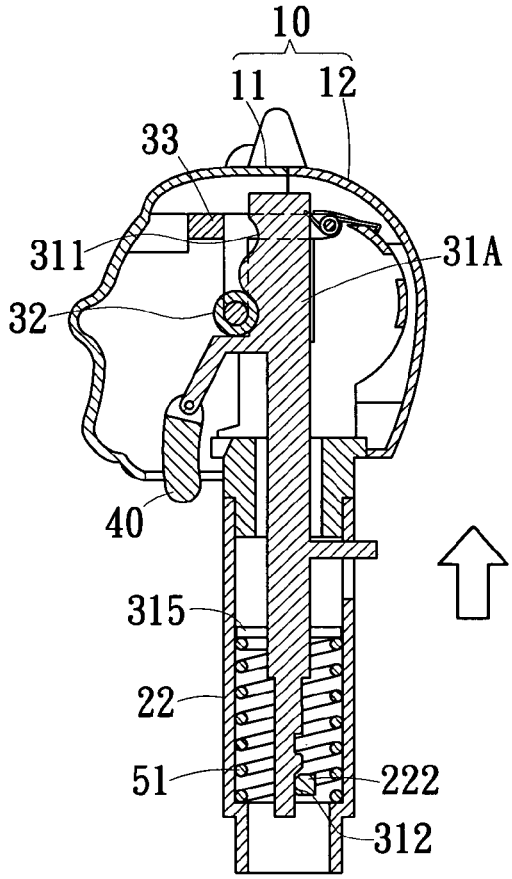
FIG. 5 is a sectional view of the first embodiment, in retraction mode.

Referring to FIG. 5, when the protruding pin (313) is pulled upwardly, said the pole (222) disengage the groove (312), releasing compressed elastic element (50) and pushing the retainer (315) of the long driving link (31A) upwardly. The first driven element (32) is driven upward by the movement of driving link (31A), causing the second driven element (33), front case (11) and first elastic element to react, retracting the protracting element (40) into the decorative housing (10).

Figure 6:
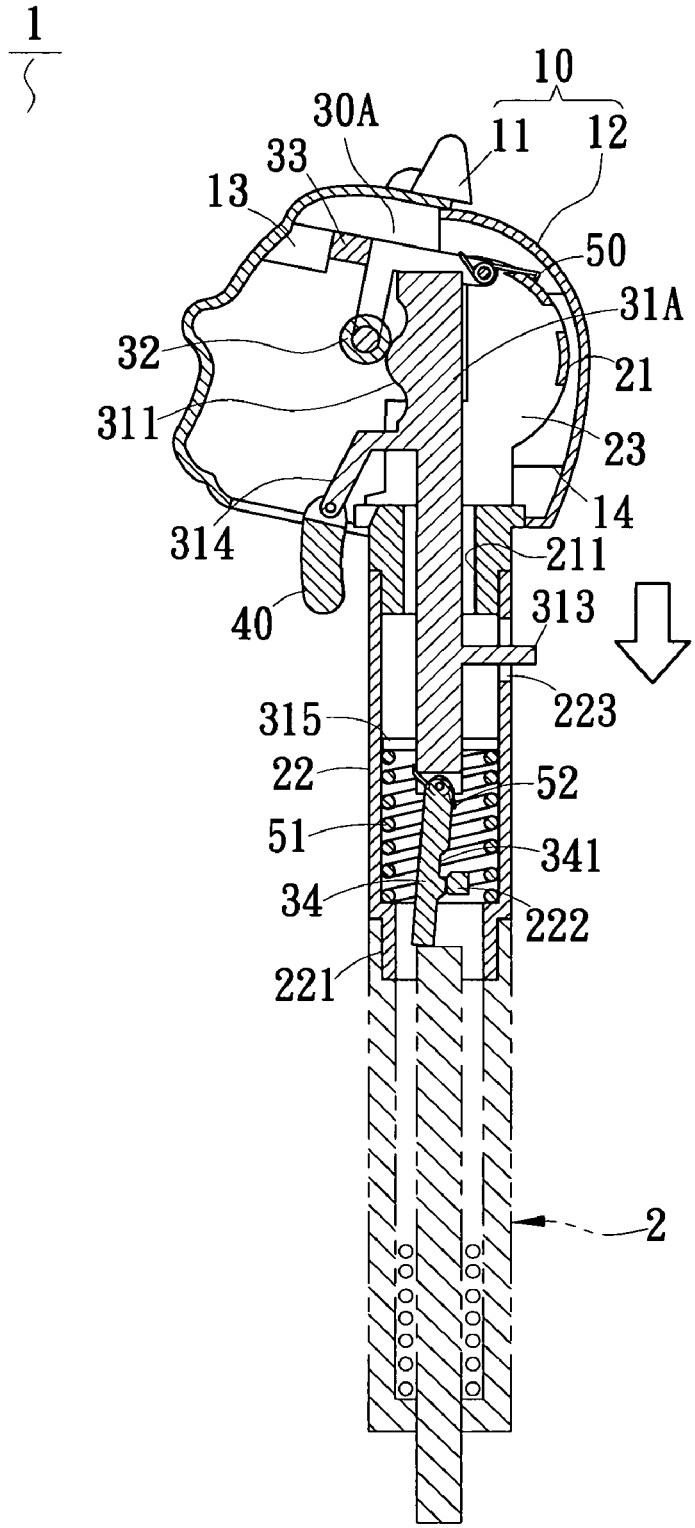
FIG. 6 is a sectional view of the first embodiment coupled with a movable driven element (34).

An alternative form of first embodiment is shown in FIG. 6, the difference between the alternative form and previous embodiment is that a third driven element (34) is attached to a bottom end of the long driving link (31A) to drive the rod object (2), and a groove (341) is disposed on a side of the third driven element (34) for corresponding said pole (222). Thus, the long driving link (31A) will not incline during its reciprocal movement caused by the pole (222), and avoid possibility that slant link (31A) damages other components.

A third elastic element (52) is set on where the third driven element (34) jointed with the long driving link (31A) for a instant reposition of the driven element (34) when passes the pole (222). The elastic element (52) also provides a fast engagement of the groove (341) and pole (222).

Second Embodiment

Figure 7:
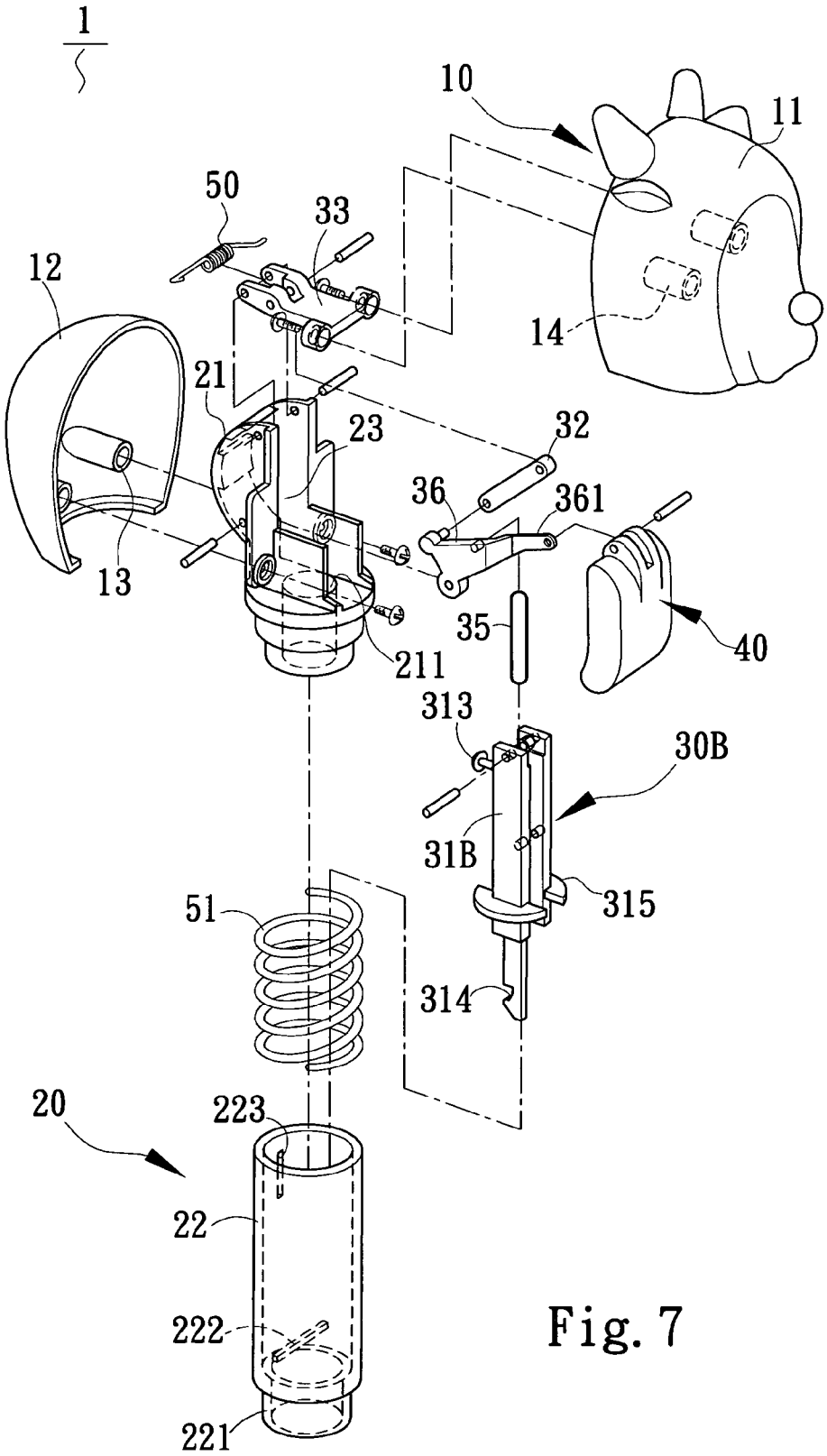
FIG. 7 is an exploded view of the second embodiment.

As illustrated in FIG. 7, the second embodiment of an amusing ornament is differed from the first embodiment by having a linkage unit (30B) which consists essentially of a short driving link (31B) whose the bottom portion passes through said hole (211) and is given sliding movement by inserting into the tube (22), a forth driven element (35) driven by the short driving link (31B), a fifth driven element (36) having three ends pin jointed with the seat (21), the forth driven element (35) and first driven element (32) respectively, a second driven element (33) having two ends pin jointed with the seat (21) and first driven element (32) respectively and another end coupled with the front case (11), a first elastic element (50) disposed on where the second driven element (33) pin jointed with the seat (22) for providing reciprocal movement to the second driven element (33), and a second elastic element (51) incorporated in the tube (22) for providing reciprocal movement to the long driving link (31A). A protracting element (40) is further pivotally connected the fifth driven element (36).

As shown in FIG. 5, the protracting element (40) of the first embodiment is only partially covered by the housing (10), left a portion exposed. Thus, in the second embodiment, by linking the short driving link (31B) with the first, second, fourth and fifth driven elements (32, 33, 35, 36), the protracting element (40) is completely hidden inside the housing (10) without altering shapes of housing (10) and protracting element (40). And with two elastic elements (50, 51) installed, reciprocal movements of decorative housing (10) and protracting element (40) are stabilized, and protracting element (40) is protruded sharply.

A groove (312) is disposed on a side of the short driving link (31B) for corresponding said pole (222). A protruding pin (313) is extended from a side of said short driving link (31B); and a guide slot (223) is disposed on a side wall of the tube (22) for allowing the pin (313) to pass through and securing the movement thereof.

Figure 8:
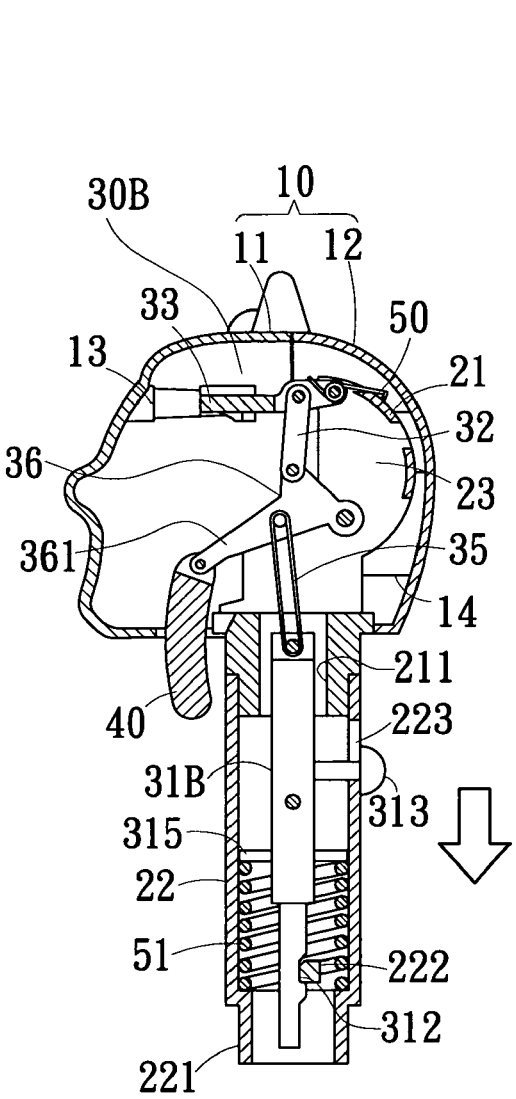
FIG. 8 is a sectional view of the second embodiment in protraction mode.

As shown in FIG. 8, said fifth driven element (36) possesses a shape of a triangle which three vertices are pivotally connected with the seat (21), first driven element (32) and protracting element (40). One of vertex is extended to form an arm (361) for attaching said protracting element (40) and another end of said arm (361) is jointed with an end of the fourth driven element (35). Said driven element (35) can be selected from an elastic loop, a shaft or a spring. Said element (35) can reduce the displacement of the driving link (31B) when passing the pole (222) of the tube (22) and stabilizes the movement.

Therefore, when the driving link (31B) is triggered and pulled downwardly, the fourth driven element (35) is driven by said force and pulls down the arm (361) of the fifth element (36). Since the firth driven element (32) is jointed with the fifth element (36), movement of the arm (361) causes reaction of the driven element (32) and generates a force to the second driven element (33) to open the front case (11), exposing the protracting element (40) from the decorative housing (10).

Figure 9:
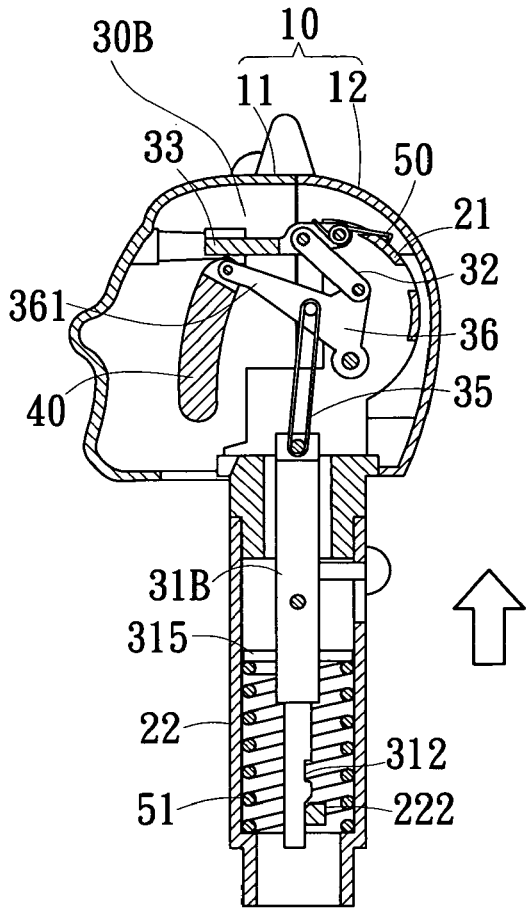
FIG. 9 is a sectional view of the second embodiment, in retraction mode.

The retraction of the protracting element (40) is illustrated in FIG. 9, since it is the same action in reverse, no detail description is described.

Figure 10:
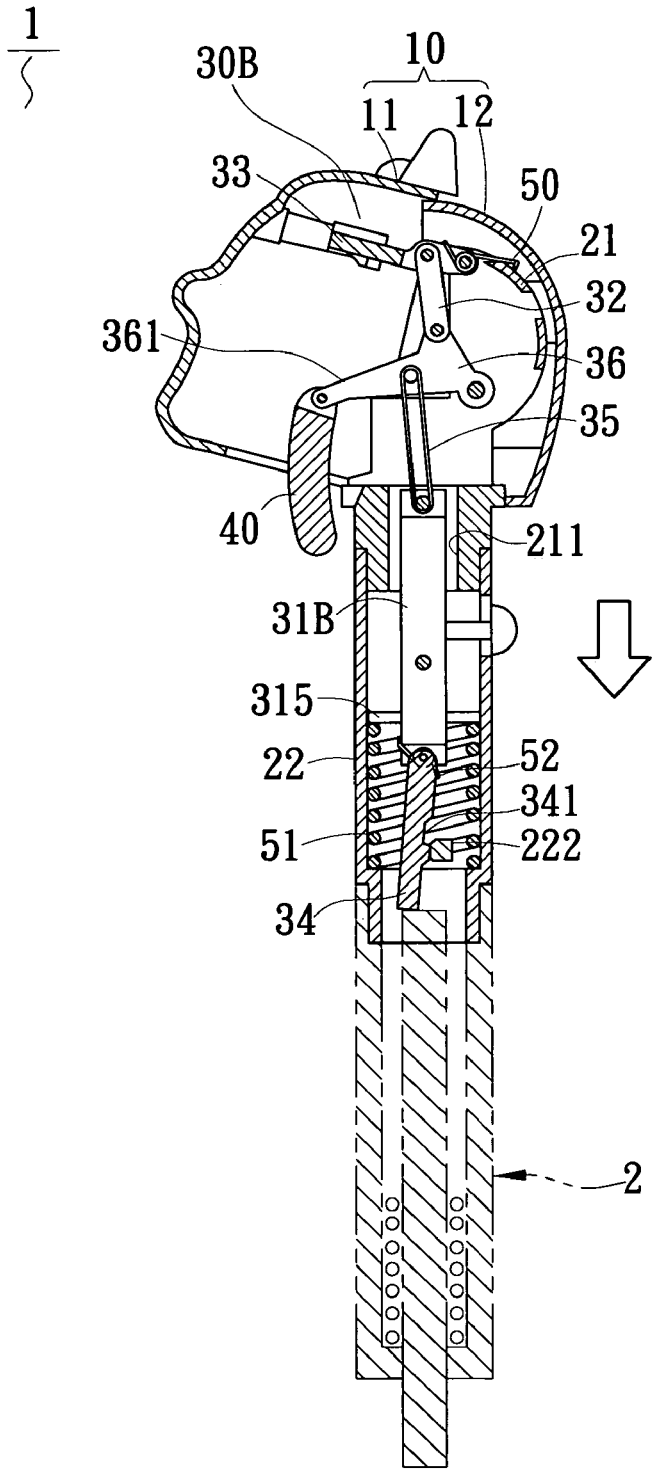
FIG. 10 is a sectional view of the second embodiment coupled with a movable driven element (34).

As shown in FIG. 10, an alternative variation also can be applied to the second embodiment, the alternative form differs from the previous second embodiment by including a third driven element (34) pin jointed with a bottom end of the short driving link (31B) to drive the rod object (2), a groove (341) disposed on a side of the third driven element (34) for corresponding said pole (222), and a third elastic element (52) disposed on where said short driving link (31B) joints with the third driven element (34) for providing reciprocal movement.

Since the driving link (31B) is shorter than the driving link (31A), the incline angle thereof should be greater therefore, and affects the operation of the ornament. By attaching said driven element (34) onto the bottom of the driving link (31B), the inclination of driving link (31B) is avoided and proper function of the ornament is ensured.

What is claimed is:

1. An action ornament for mounting on a rod object (2) comprises:

A decorative housing (10) which consists of a front case (11) and a rear case (12);

A main body (20) engaged with said housing (10) includes a seat (21) disposed on a top of said body (20), and a hollow tube (22) attached to a bottom of said seat (1); said seat (21) having a hole (211) in a centre is joined with said rear case (12), and said tube (22) incorporated a horizontal pole (222) comprises a connecting element (221) provided on a bottom thereof for engaging with said rod object (2);

A linkage unit (30A) which is partially provided into said housing (10), consists essentially of a long driving link (31A) whose a bottom portion passes through said hole (211) and is allowed to slide inside the tube (22), a first driven element (32) driven by the long driving link (31A), a second driven element (33) having two ends pin jointed with the seat (21) and first driven element (32) respectively and another end coupled with the front case (11), a first elastic element (50) disposed on where the second driven element (33) pin jointed with the seat (22) for providing reciprocal movement to the second driven element (33), a second elastic element (51) incorporated in the tube (22) for providing reciprocal movement to the long driving link (31A); and A protracting element (40), provided inside said housing (10) is pin jointed with the long driving link (31A).

2. An action ornament of claim 1, wherein a wave structure (311) is provided on a side of an upper portion of the long driving link (31A) for corresponding the first driven element (32) and a groove (312) is disposed on a side of a lower portion of the long driving link (31A) for corresponding said pole (222).

3. An action ornament of claim 1, wherein a third driven element (34) is pivotally connected with a bottom end of the long driving link (31A) to drive the rod object (2), and a groove (341) is disposed on a side of the third driven element (34) for corresponding said pole (222).

4. An action ornament of claim 3, wherein a third elastic element (52) is disposed on where said long driving link (31A) joints with the third driven element (34) for providing reciprocal movement.

5. An action ornament of claim 1, wherein a protruding pin (313) is provided on a side of said long driving link (31A); and a guide slot (223) is disposed on a side wall of the tube (22) for allowing the pin (313) to pass through and limiting the movement thereof.

6. An action ornament of claim 1, wherein said first driven element (32) is a roller.

7. An action ornament for mounting on a rod object (2) comprises:

A decorative housing (10) which consists of a front case (11) and a rear case (12);

A main body (20) which couples with said housing (10) includes a seat (21), disposed on a top of said body (20), and a hollow tube (22), coupled with a bottom of said seat (1); said seat (21), having a hole (211) in a centre is joined with said rear case (12), and said tube (22) incorporated a horizontal pole (222) comprises a connecting element (221) provided on a bottom of said tube (22) for coupling with said rod object (2);

A linkage unit (30B) which is partially inserted into said housing (10), consists essentially of a short driving link (31B) whose a bottom portion passes through said hole (211) and is given sliding movement by inserting into the tube (22), a forth driven element (35) driven by the short driving link (31B), a fifth driven element (36) having three ends pivotally connected with the seat (21), the forth driven element (35) and first driven element (32) respectively, a second driven element (33) having two ends jointed with the seat (21) and first driven element (32) respectively and another end coupled with the front case (11), a first elastic element (50) disposed on where the second driven element (33) pivotally connected with the seat (22) for providing reciprocal movement to the second driven element (33), a second elastic element (51) incorporated in the tube (22) for providing reciprocal movement to the long driving link (31A); and A protracting element (40), incorporated in said housing (10) is pivotally connected with the fifth driven element (31A).

8. An action ornament of claim 7, wherein a groove (312) is disposed on a side of the short driving link (31B) for corresponding said pole (222).

9. An action ornament of claim 7, wherein a third driven element (34) is jointed with a bottom end of the short driving link (31B) to drive the rod object (2), and a groove (341) is disposed on a side of the third driven element (34) for corresponding said pole (222).

10. An action ornament of claim 9, wherein a third elastic element (52) is disposed on where said short driving link (31B) joints with the third driven element (34) for providing reciprocal movement.

11. An action ornament of claim 7, wherein a protruding pin (313) is provided from a side of said short driving link (31B); and a guide slot (223) is disposed on a side wall of the tube (22) for allowing the pin (313) to pass through and securing the movement thereof.

12. An action ornament of claim 1, wherein said first driven element (32) is a link rod.

* * * * *